US006652422B1

(12) United States Patent
Day

(10) Patent No.: US 6,652,422 B1
(45) Date of Patent: Nov. 25, 2003

(54) DUAL PURPOSE LIGHTWEIGHT VEHICLE FOR GLIDING ON SNOW OR ICE

(76) Inventor: Ming-Ching Day, No. 9-1, Ho-Tien Lane, Chang-Sha Village, Hua-Tan Hsiang, Chang Hua Hsien (TW)

( * ) Notice: Subject to any disclaimer, the term of this patent is extended or adjusted under 35 U.S.C. 154(b) by 0 days.

(21) Appl. No.: 10/071,151

(22) Filed: Feb. 11, 2002

(51) Int. Cl.[7] ..... A63B 71/00
(52) U.S. Cl. ..... 482/51; 280/14.27; 280/14.28
(58) Field of Search ..... 280/14.27, 14.28, 280/14.3, 21.1, 22, 87.04, 605–609; 482/51

(56) References Cited

U.S. PATENT DOCUMENTS 1,524,850 A * 2/1925 Van Daam ..... 280/14.28
D126,833 S * 4/1941 Hylan ..... D12/8
4,666,171 A * 5/1987 Sellers ..... 280/18
4,773,659 A * 9/1988 Rygiel ..... 280/142
5,145,201 A * 9/1992 Metheny ..... 280/609
5,516,126 A * 5/1996 Myers ..... 280/14.28
D401,287 S * 11/1998 Ritzinger ..... D21/760
5,868,405 A * 2/1999 Lavecchia et al. ..... 280/14.21
6,062,585 A * 5/2000 Hess ..... 280/608
D463,839 S * 10/2002 Fireman et al. ..... D21/760

* cited by examiner

*Primary Examiner*—Nicholas D. Lucchesi
*Assistant Examiner*—Tam Nguyen
(74) *Attorney, Agent, or Firm*—Harrison & Egbert

(57) ABSTRACT

A light vehicle is designed to glide on snow or ice and is formed of a footboard with a runner at each longitudinal end thereof, a steering handlebar fastened pivotally with the front end of the footboard, and a braking device fastened with the rear end of the footboard. The runners are provided with a guiding projection, two steering projections with a braking tip extending therefrom, and a snow guiding recess located between the guiding projection and each steering projection.

3 Claims, 8 Drawing Sheets

DUAL PURPOSE LIGHTWEIGHT VEHICLE FOR GLIDING ON SNOW OR ICE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a light vehicle for amusement and exercise, and more particularly to a light vehicle for gliding on snow or ice.

BACKGROUND OF THE INVENTION

The scooter is a popular light vehicle for riding on the ground for the purpose of amusement and exercise. In light of the unique characteristics of the scooter, the scooter may be modified in a manner that it can be used for gliding on snow or ice for the purpose of amusement and exercise. Such a modified scooter as described above is called "snowscooter".

BRIEF SUMMARY OF THE INVENTION

The primary objective of the present invention is to provide a light vehicle which is designed for gliding on snow or ice for the purpose of amusement and exercise.

In keeping with the principle of the present invention, the foregoing objective of the present invention is attained by a light vehicle comprising a footboard with a runner at each longitudinal end thereof, a raised handlebar for steering, and a braking device.

The features and the advantages of the light vehicle of the present invention will be more readily understood upon a thoughtful deliberation of the following detailed description of the present invention with reference to the accompanying drawings.

DETAILED DESCRIPTION OF THE INVENTION

Figure 1:
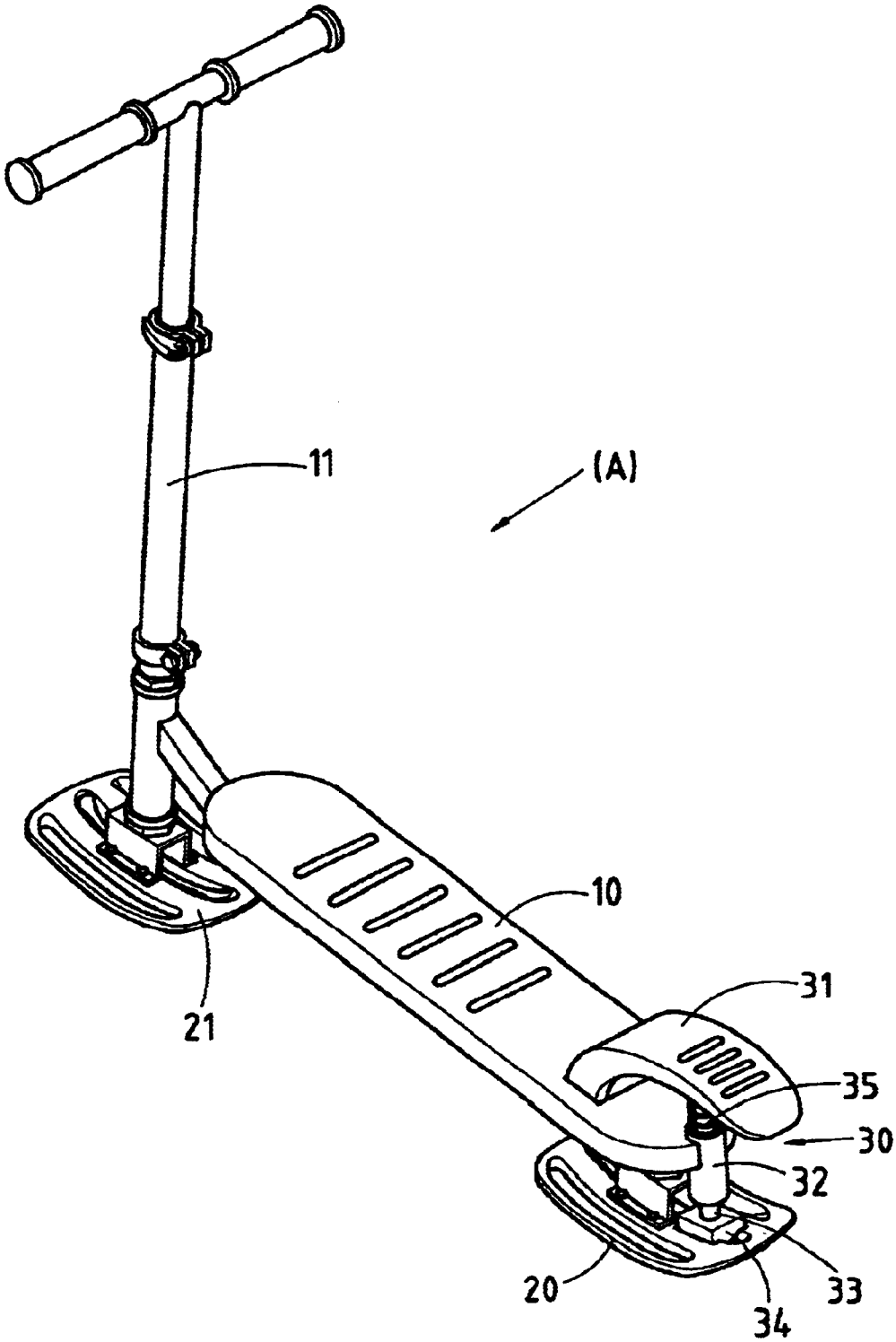
FIG. 1 shows a perspective view of the present invention.
Figure 2:
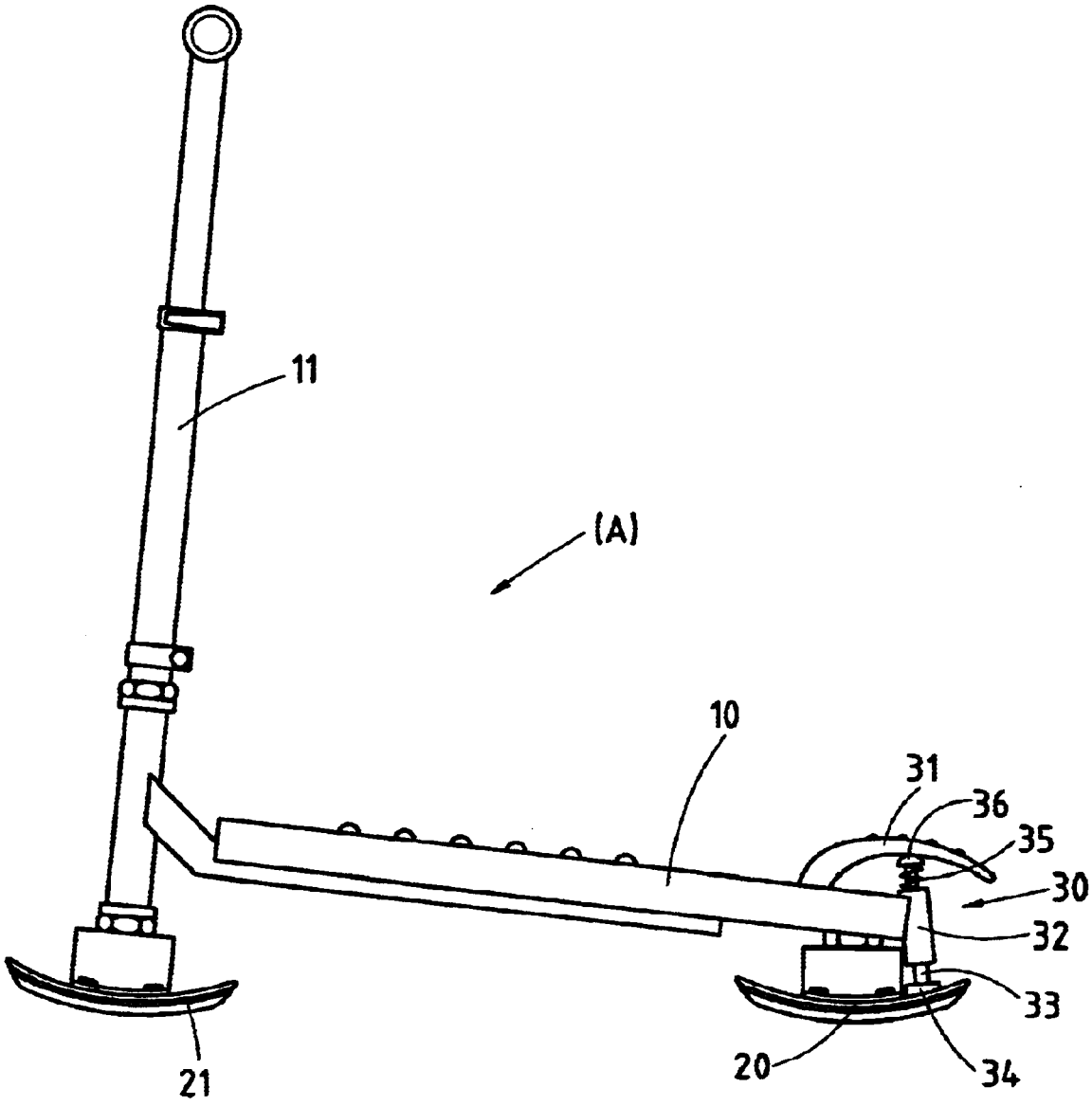
FIG. 2 shows a side view of the present invention.

As shown in FIGS. 1–6, a light vehicle "A" embodied in the present invention is intended for gliding on snow or ice for the purpose of amusement and exercise and is formed of a footboard 10, a raised handlebar 11 for steering, a rear runner 20, a front runner 21 and a braking device 30.

The handlebar 11 is fastened pivotally with the front end of the footboard 10. The front runner 21 is fastened with the bottom end of the handlebar 11. The rear runner 20 is fastened with the underside of the rear end of the footboard 10 in conjunction with the braking device 30.

Figure 8:
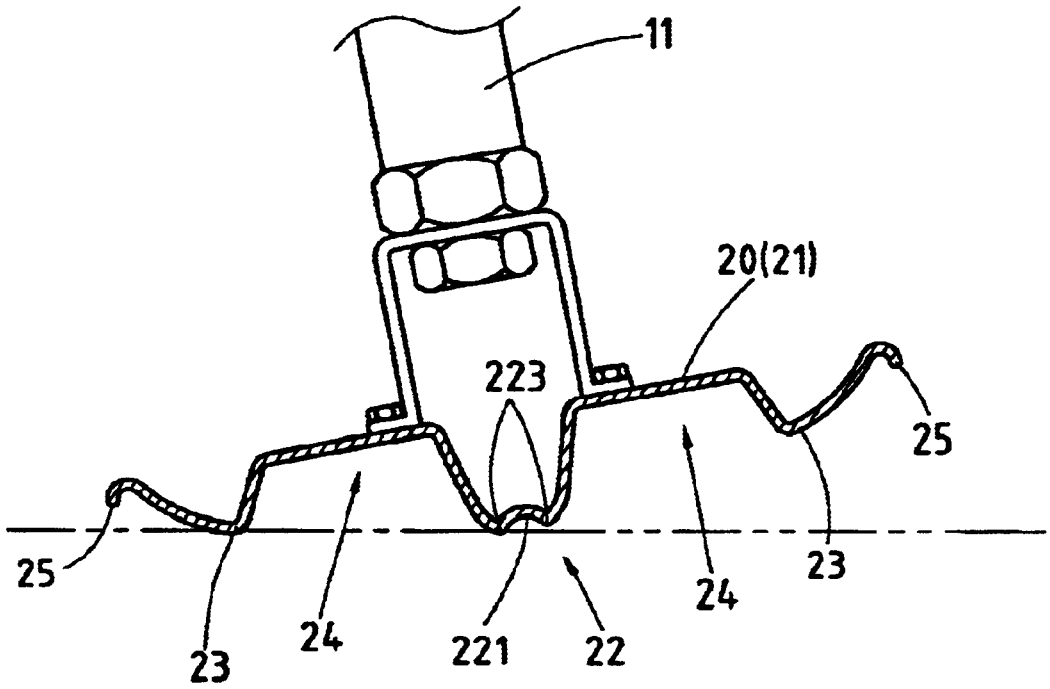
FIG. 8 shows a front schematic view of the present invention in the act of tilting slightly.
Figure 9:
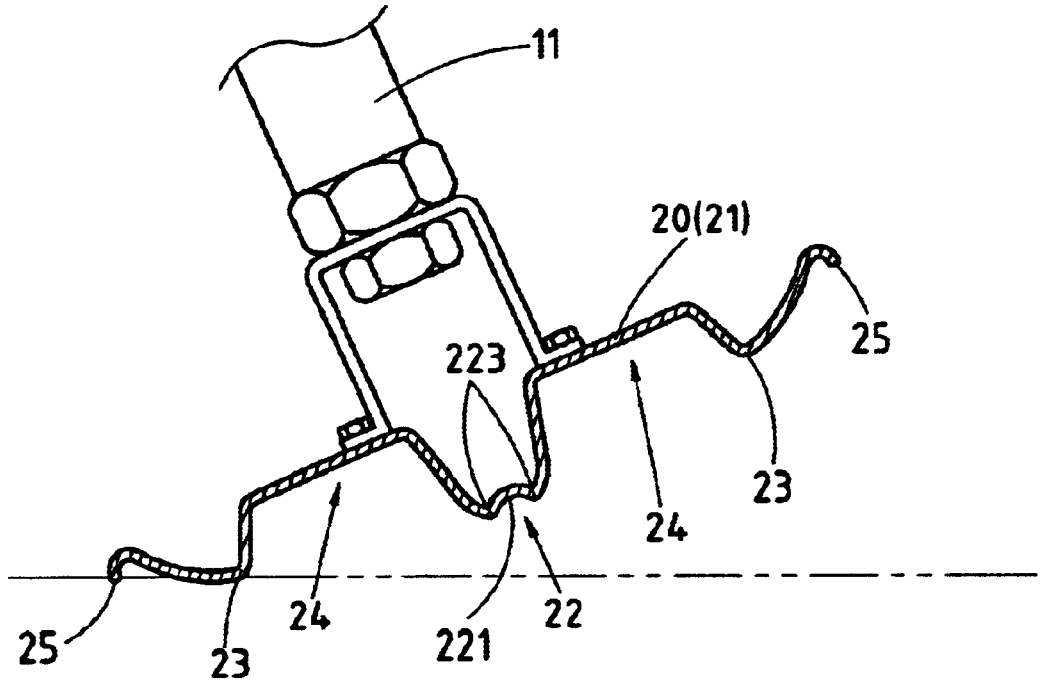
FIG. 9 shows a front schematic view of the present invention in the act of tilting severely.

The rear runner 20 and the front runner 21 are basically similar in construction and are arcuate in the longitudinal section. The rear runner 20 and the front runner 21 are provided in the center of the underside with a guiding projection 22, in two opposite fringes with a steering projection 23 and a braking tip 25 extending from the steering projection 23, and a snow guiding recess 24 located between the guiding projection 22 and the steering projection 23. The guiding projections 22 of the rear runner 20 and the front runner 21 serve to guide the gliding direction of the light vehicle "A" of the present invention. The steering projections 23 of the 'rear runner 20 and the front runner 21 are used at such time when the light vehicle "A" is tilted to make a turn or negotiate a curve, as illustrated in FIGS. 8 and 9. The braking tips 25 of the rear runner 20 and the front runner 21 serve to reduce the speed of the light vehicle of the present invention by making contact with the snow or ice at the time when the light vehicle "A" in motion is making a turn or negotiating a curve.

The guiding projections 22 of the rear runner 20 and the front runner 21 are provided with two guiding edges 223 opposite to each other, and a guiding recess 221 located between the two guiding edges 223. The guiding edges 223 are capable of cutting into the ice surface to guide the gliding direction of the light vehicle "A" of the present invention.

Figure 3:
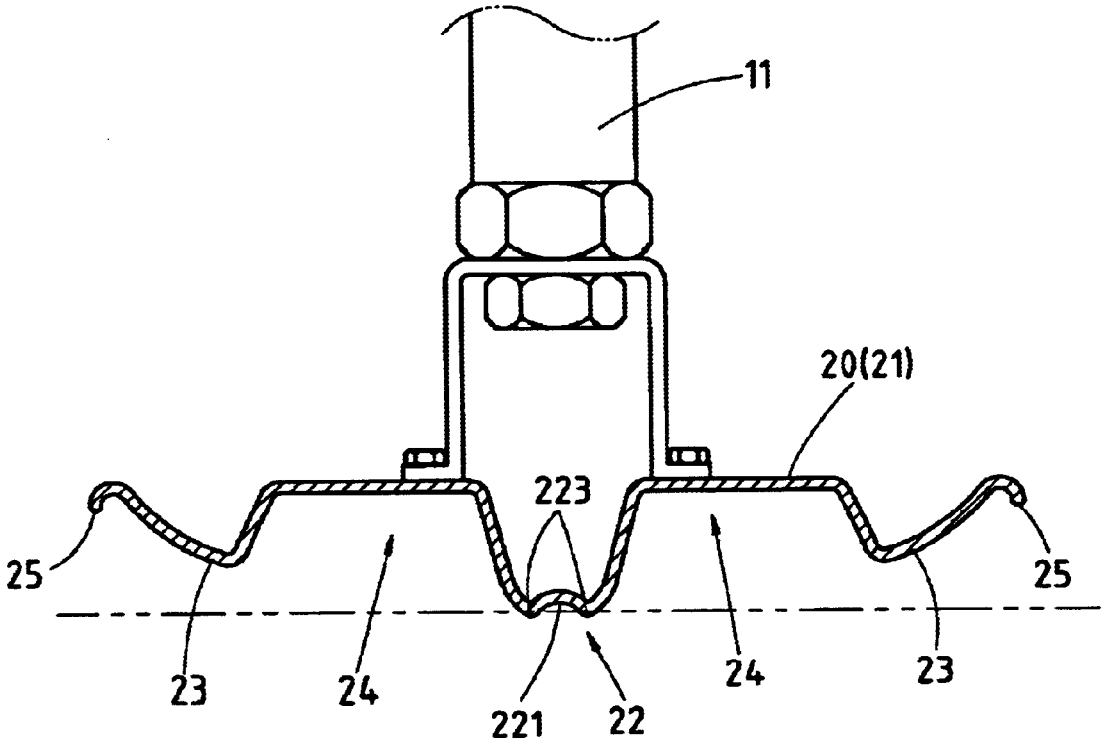
FIG. 3 shows a sectional schematic view of the runner of the present invention.
Figure 4:
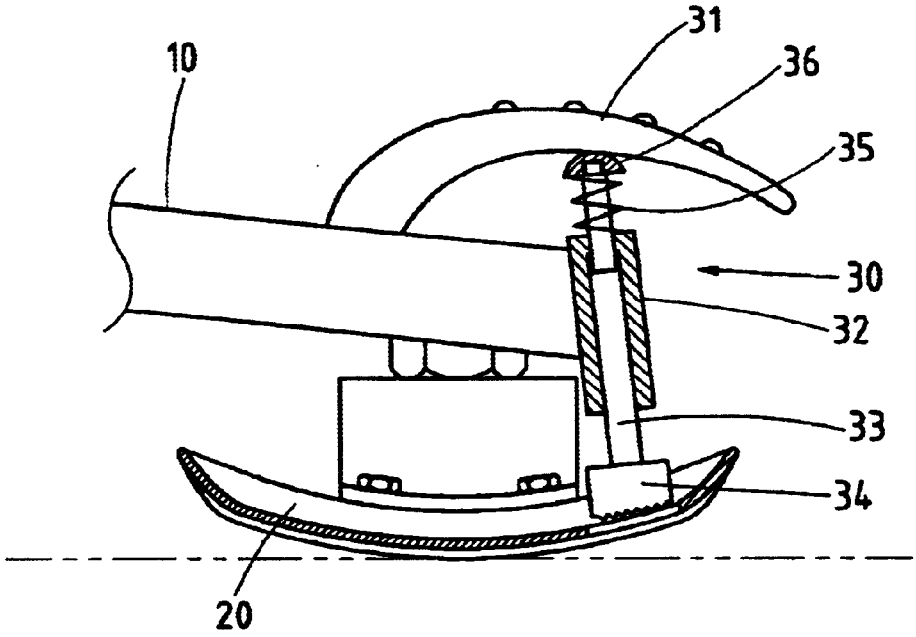
FIG. 4 shows a sectional schematic view of the braking device of the present invention.
Figure 5:
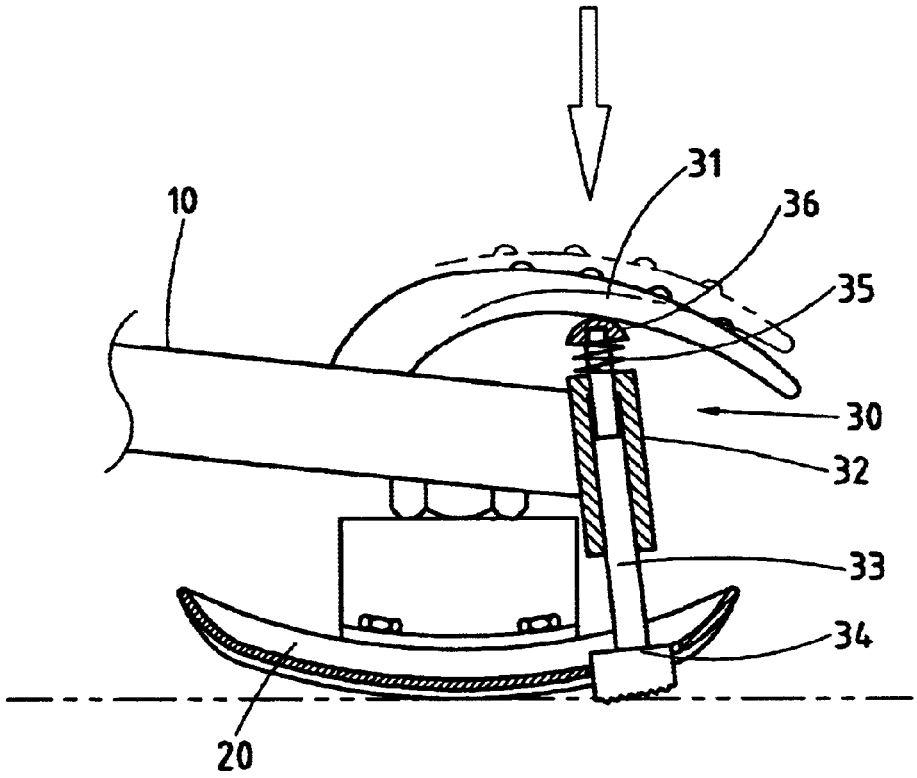
FIG. 5 shows a sectional schematic view of the braking device of the present invention in action.

As shown in FIG. 3, when the light vehicle "A" of the present invention is gliding on the snow, the guiding projection 22 sinks deeper into the snow while the two steering projections 23 work to guide the gliding direction of the light vehicle "A" of the present invention.

The braking device 30 comprises a trigger plate 31, a guide tube 32 located between the rear end of the footboard 10 and the rear runner 20 for receiving a link rod 33 which is provided at the bottom end with a brake shoe 34 fastened therewith, and at the top end with a stop piece 36. A spring 35 is fitted over the top end of the link rod 33 such that one end of the spring 35 is stopped by the stop piece 36 which is in contact with the underside of the trigger plate 31, and that other end of the spring 35 is stopped by the top end of the guide tube 32. The guide tube 32 is fastened to the rear end of the footboard 10. The rear runner 20 is provided with a through hole 41 corresponding in location to the brake shoe 34. When the trigger plate 31 is exerted on by an external force, the brake shoe 34 is forced to make contact with the snow or ice via the through hole 41 of the rear runner 20, thereby resulting in a braking effect on the light vehicle "A" in motion. It must be noted here that the trigger plate 31 is fastened at one end with the footboard 10 such that the trigger plate 31 is forced by the recovery force of the spring 35 to return to its original position at the time when the trigger plate 31 is relieved of the external force exerting thereon.

Figure 6:
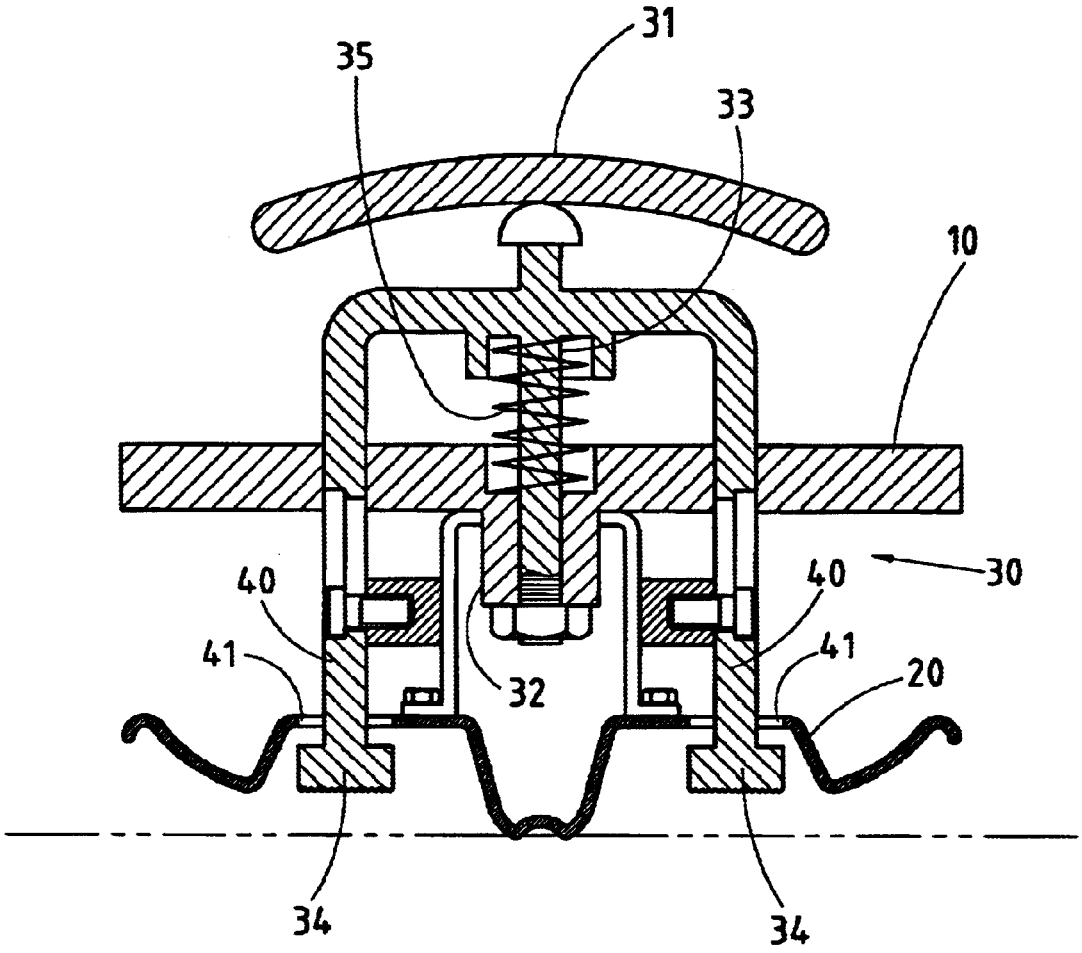
FIG. 6 shows a sectional schematic view of a braking device of another embodiment of the present invention.

As shown in FIG. 6, the braking device 30 of the present invention comprises two brake shoes 34 to enhance the braking effect of the braking device 30. These two brake shoes 34 are fastened to the free ends of two arms 40 which are extended from the link rod 33.

Figure 7:
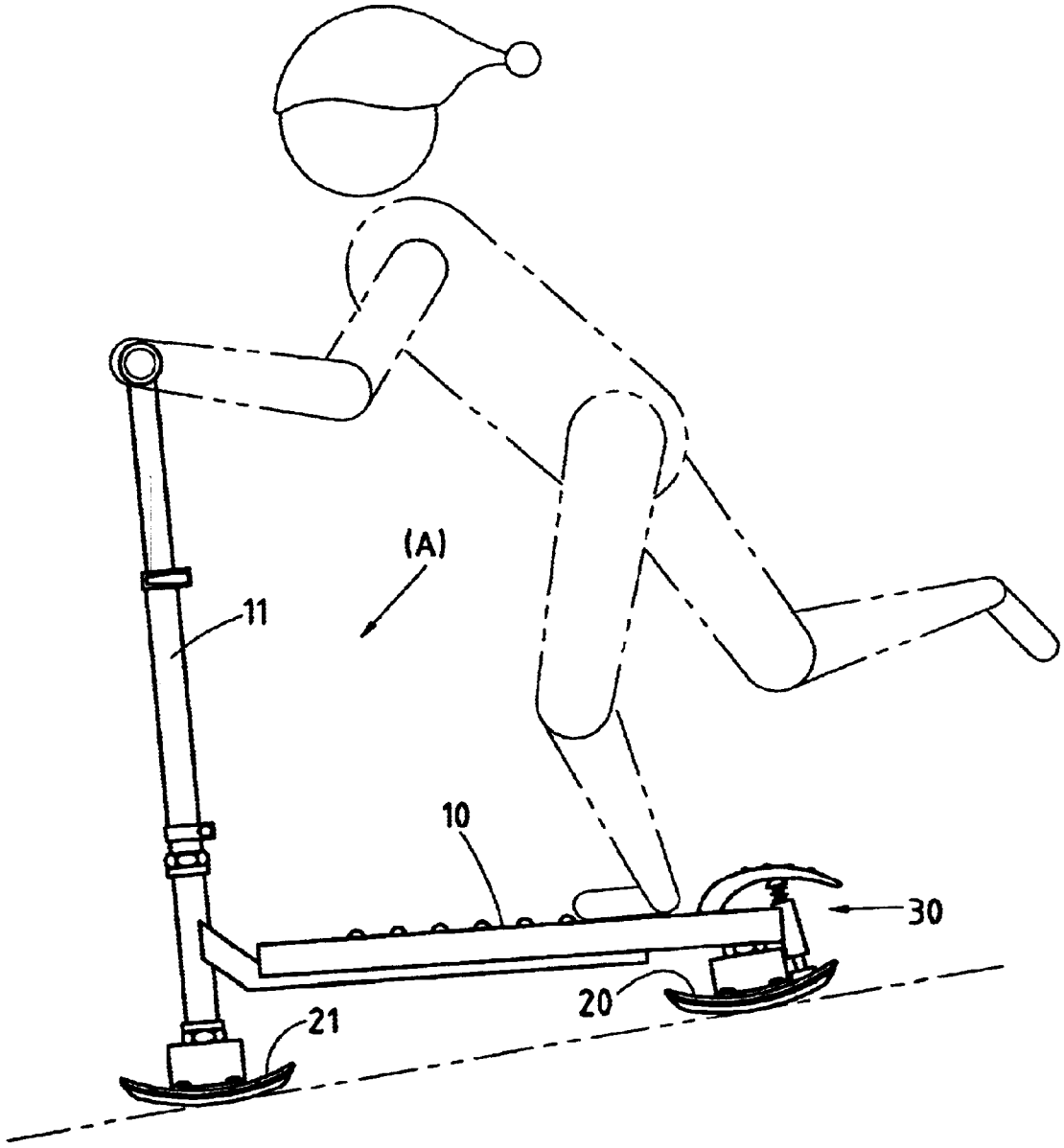
FIG. 7 shows a side schematic view of the present invention in operation.

As illustrated in FIG. 7, the light vehicle "A" of the present invention is moved by a rider on snow or ice. It is moved by a series of pushes made by one foot of the rider against the snow or ice.

The present invention described above is to be regarded in all respects as being illustrative and nonrestrictive. Accordingly, the present invention may be embodied in other specific forms without deviating from the spirit thereof. The present invention is therefore to be limited only by the scopes of the following claims.

I claim:

1. A vehicle for gliding on snow or ice comprising:

a footboard having a front end and a rear end;

a handlebar;

a steering column having a top end connected to said handlebar and extending downwardly therefrom;

a front runner fastened to a bottom end of said steering column, said front runner having a guiding projection formed in a center of an underside thereof, said front runner having a pair of steering projections formed respectively on opposite sides of said guiding projection on said underside of said front runner, said pair of steering projections having respective planar surfaces spacing said pair of steering projections from said guiding projection, said pair of steering projections extending downwardly from said planar surfaces for a distance less than a distance that said guiding projection extends downwardly from said planar surfaces, said front runner having a braking tip extending upwardly and outwardly from each of said pair of steering projections, said guiding projection and the respective planar surface and the respective steering projection defining a snow guiding recess;

a rear runner fastened to an underside of said rear end of said footboard, said rear runner having a guiding projection formed in a center of an underside thereof, said rear runner having a pair of steering projections formed respectively on opposite sides of said guiding projections on said underside of said rear runner, said pair of steering projections having respective planar surfaces spacing said pair of steering projections from said guiding projection on said rear runner, said pair of steering projections of said rear runner extending downwardly from said planar surfaces for a distance less than a distance that said guiding projection of said rear runner extends downwardly from said planar surfaces, said rear runner having a braking tip extending upwardly and outwardly from each of said pair of steering projections, said guiding projection and the respective planar surface and the respective steering projection defining a snow guiding recess on said rear runner, at least one of said planar surfaces of said rear runner having a through hole formed therein; and a braking mechanism fastened to said rear end of said footboard, said braking mechanism having a trigger plate fastened at one end to said rear end of said footboard, said braking mechanism having a guide tube fastened to said rear end of said footboard, said braking mechanism having a link rod held by said guide tube, said link rod having a stop piece affixed to a top end thereof, said stop piece being in contact with an underside of said trigger plate, said braking mechanism having a recovery spring fitted over said top end of said link rod such that one end of said recovery spring exerts a force upon said stop piece and such that an opposite end of said recovery spring exerts a force against a top end of said guide tube, said braking mechanism having a brake shoe fastened to a bottom end of said link rod and extended through said through hole, said brake shoe being movable downwardly when an external pressure is directed downwardly onto said trigger plate.

2. The vehicle of claim 1, said guiding projection of said front runner and said guiding projection of said rear runner each having a pair of guiding edges spaced from each other and a guiding recess located between said pair of guiding edges.

3. The vehicle of claim 1, said link rod of said braking mechanism having a pair of arms extending therefrom, said brake shoe comprising, a first brake shoe affixed at a bottom of one of said pair of arms and a second brake shoe affixed at a bottom of another of said pair of arms, said through holes comprising a first through hole formed in one of said planar surfaces and a second through hole formed in another of said planar surfaces, said pair of arms respectively extending through said first and second through holes.

* * * * *